US005950539A

United States Patent [19]

Manzini

[11] Patent Number: 5,950,539

[45] Date of Patent: Sep. 14, 1999

[54] LETTERPRESS MACHINE FOR CONTINUOUS PRINTING

[75] Inventor: Amerigo Manzini, Lecco, Italy

[73] Assignee: OMET S.r.l., Lecco, Italy

[21] Appl. No.: 09/166,971

[22] Filed: Oct. 6, 1998

[30] Foreign Application Priority Data

Oct. 10, 1997 [IT] Italy ..... MI97A02296 U

[51] Int. Cl.[6] ..... B41F 7/02

[52] U.S. Cl. ..... 101/217; 101/218; 101/247; 101/352.01

[58] Field of Search ..... 101/323, 328–331, 101/216–218, 247, 317, 318, 352.01–352.05, 361, 362, 379.1

[56] References Cited

U.S. PATENT DOCUMENTS

| | | | |
|---|---|---|---|
| 4,889,051 | 12/1989 | Sarda | 101/77 |
| 5,134,934 | 8/1992 | Knauer et al. | 101/143 |
| 5,186,103 | 2/1993 | Gelinas et al. | 101/181 |
| 5,351,616 | 10/1994 | Gelinas et al. | 101/218 |
| 5,546,860 | 8/1996 | Riis | 101/247 |
| 5,588,362 | 12/1996 | Sugiyyama et al. | 101/218 |

*Primary Examiner*—Edgar Burr
*Assistant Examiner*—Dave A. Ghatt
*Attorney, Agent, or Firm*—Cobrin & Gittes

[57] ABSTRACT

An improved printing machine comprises: a frame, at least one cliché carrying roller fitted rotationally on the frame, the cliché carrying roller being interchangeable with cliché carrying rollers of different diameters, at least one inking roller fitted rotationally on the frame parallel to and in contact with the cliché carrying roller, the inking roller being mobile along an arc of circle to enable it to make contact with cliché carrying rollers of different diameters, at least one disk joined to each cliché carrying roller, at least one cam joined to the inking roller and in contact with the disk. Means are provided for automatically rotating the cam in relation to the movements of the inking roller to maintain the cam regulation of the inking roller with respect to the cliché carrying roller.

4 Claims, 2 Drawing Sheets

LETTERPRESS MACHINE FOR CONTINUOUS PRINTING

BACKGROUND OF THE INVENTION

1. Field of the Invention

The invention relates to a continuous printing machine and in particular to a machine for typographical printing. These machines in general comprise a number of printing units in series, each of which is fitted with a plate or cliché carrying roller which, rolling on a counterpressure roller, called print roller, transfers the image from the inked cliché to a ribbon of paper or other material fed between the two aforementioned rollers. The cliché carriyng roller is in turn inked by at least another roller called inking roller, having a surface in an at least partially absorbent material to draw ink from a source of it and continuously transfer the same, via one or more distribution rollers, to the cliché carrying roller.

For high quality printing, it is imperative that the quantity of ink transferred from the inking roller or rollers to the cliché carrying roller be perfectly regulated; if too much ink is transferred to the cliché carrying roller, then some areas would be inked which should not be, and if too little ink is transferred, there would be areas without ink which should have been inked. In order to regulate this supply, the cliché carrying roller is fitted on one or preferably both sides with reference disks having a constant diameter equal to the diameter of the cliché carrying roller when a cliché is ftted thereon. Likewise, one or preferably two cams are coupled to each inking roller, said cams being integral with the axis of the inking roller but do not rotating with it; these cams can be registered in position with reference to the disks on the cliché carrying roller to determine the correct pressure between the two roller in operation. The setting of this cams is very critical and requires skilled personnel and a lot of time to carry out correctly.

In the most recent typographic printing machines the structure of the machine, or rather of each printing unit, is such as to enable the cliché carrying roller to be substituted by rollers with different diameters depending on the formats to be printed. The cliché carrying rollers are substituted while the position and size of the print or counterpressure roller remains constant, in such a manner that the axis of the cliché carrying roller moves closer or further away from the print roller axis, depending on whether the substituting cliché carrying roller has a smaller or larger diameter.

It is obvious that, when changing the cliché carrying roller size, the inking roller or rollers must be able to always work in contact with the cliché carrying roller, and accordingly to work with all cliché carrying roller that can be fitted. For that reason, the inking rollers are fitted in a mobile way within different possible positions by moving their axes along an arc of a circle so that they approach or depart the area where the cliché carrying roller lies, until they make contact with its surface. Moreover, since the inking rollers move along an arc of a circle centered on a rotation axis in the frame of the machine to keep in contact with the surface of the cliché carrying roller each time the latter is substituted on a printing unit, then the cam or pair of cams associated with each inking roller move in a similar way along an arc having the same center. When, at the end of its rotation, the cam is into contact with the disk on the new cliché carrying roller, the point of contact between the inking roller cam and the cliché carrying roller disk is no longer the same as the original setup. If printing were proceeded with under these conditions, as the original registration is changed, the ink supply would be incorrect, either too much or too little being delivered. Accordingly, at every change of format of the cliché carrying roller it is necessary to reset the inking roller cam to get optimum inking. Such a reset would take up capacity, personnel, time etc.

OBJECTS OF THE INVENTION

Based on this premise, an object of the present invention is to provide a continuous printing machine and especially a machine for typographical printing, of the type defined above, in which the drawback referred to is resolved, allowing the format of the cliché carrying roller to be changed without resorting each time to a reset of the relative position of the inking roller cam with respect to the disk of the cliché carrying roller, but by automatically adjusting this setup in the course of the movement of the inking roller up to make contact again with a new format cliché carrying roller.

SUMMARY OF THE INVENTION

To achieve this and other objects, the present invention proposes a continuous printing machine and especially a machine for typographical printing, with one or more printing units in series, each of which comprises:

a frame at least one cliché carrying roller rotatably fitted on the frame and operating on the ribbon of material to be printed in cooperation with a counterpressure or print roller, said cliché carrying roller being interchangeable with other cliché carrying rollers of different diameters, at least one inking roller rotatably fitted on the frame, parallel to and in contact with said cliché carrying roller, the axis of said inking roller or rollers being mobile along an arc of a circle to keep a working contact between such inking rollers and cliché carrying rollers with different diameters, means for adjusting the contact pressure between the surfaces of the cliché carrying and inking rollers, comprising:

at least one disk coupled to each cliché carrying roller, at least one cam coupled to the shaft of each inking roller, said cam being in contact with the cliché carrying roller disk, characterized in that said cam is operatively connected to said frame by means that determine a rotation of the same corresponding to each movement of the shaft of the cliché carrying roller, giving an automatic adjustment of its position to any variation in the position of said shaft and in the diameter of the cliché carrying roller, in such a way as to maintain the point of contact of the cam with the disk or the disks on each cliché carrying roller unchanged.

The advantages of the machine according to the invention and the characteristics of the same will become evident from the following description and from the enclosed drwings, wherein:

DESCRIPTION OF THE PREFERRED EMBODIMENTS

Figure 1:
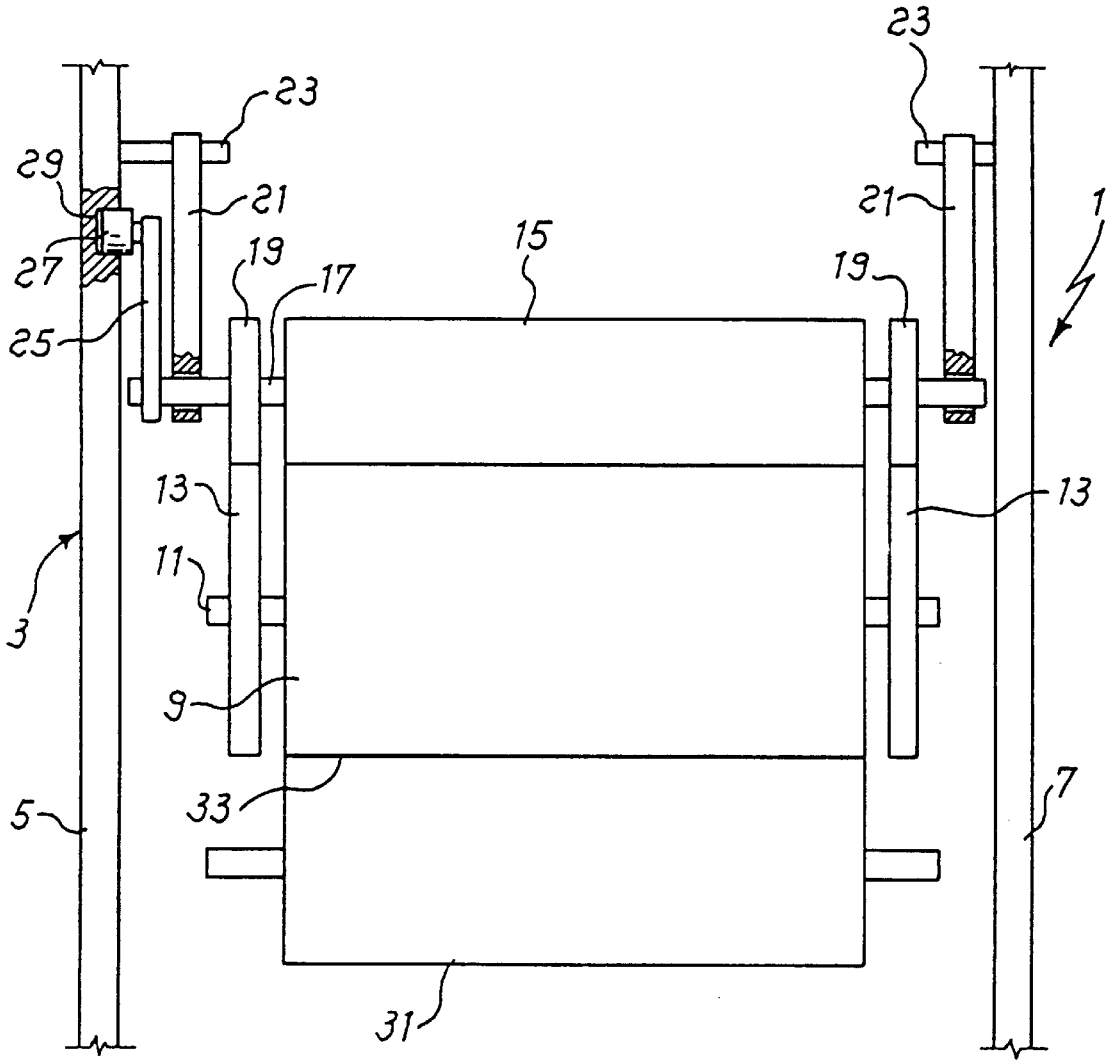
FIG. 1 is a transverse schematic view of a part of a printing unit according to the invention.

With reference at first to FIG. 1, a printing unit 1, especially for typographic printing, provides, on a frame 3, a cliché carrying roller 9 that is fitted on its circumference with one or more clichés in the form of a flexible plate applied to the same. The cliché carrying roller 9 cooperates with a counterpressure roller 31, called print roller, to effect the transfer of the ink in precise positions and configurations onto a ribbon of paper or other material 33 (FIG. 2) that is advanced at a given speed between the two rollers 9 and 31. The cliché carrying roller 9 is in its turn inked by one or more inking rollers 15, 15'—in general two inking rollers—that present an at least partially spongy external surface to pick up the ink from an ink supply, directly or through further inking rollers, and transfer it to the surface of the cliché carrying roller 9. As previously stated, it is fundamental that the cliché carrying roller is inked by the inking roller with the exact quantity of ink as required and that therefore the pressure between the cliché carrying roller 9 and the inking roller 15 is always maintained at a predetermined and adjustable level.

To effect the aforesaid adjustment, two disks 13, with a diameter exactly equal to the diameter of the cliché carrying roller with the cliché(s) applied thereto, are fitted onto the axis 11 of the cliché carrying roller 9, outside of the roller. Corresponding cams 19 fixed to the shaft 17 of the inking roller 15 bear against the disks 13. More precisely, the inking roller 15 freely rotates on its shaft 17, while the cams 19 are rotatably fixed to the shaft 17. For carrying out the adjustment of cams 19, an operator rotates the shaft 17 (or the cams 19 on the shaft 17) until the desired pressure is obtained between the rollers 9 and 15, after which the positions of the shaft 17 and cams 19 are locked.

In the more recent machines for typographic printing the printed format can be changed by replacing the cliché carrying roller 9 with other cliché carrying rollers of different diameters. Since these cliché carrying rollers 9 rest on the print roller 31 and on a support element 34 in a way already known, the substitution of the roller 9 with another of different diameter involves the movement of its shaft and therefore of the axis of rotation of the same roller, as shown for instance from 11 to 11A in FIG. 2, which shows the position of the disks 13 and 19 for the regulation of the inking pressure, as well as the position of the print roller 31.

Figure 2:
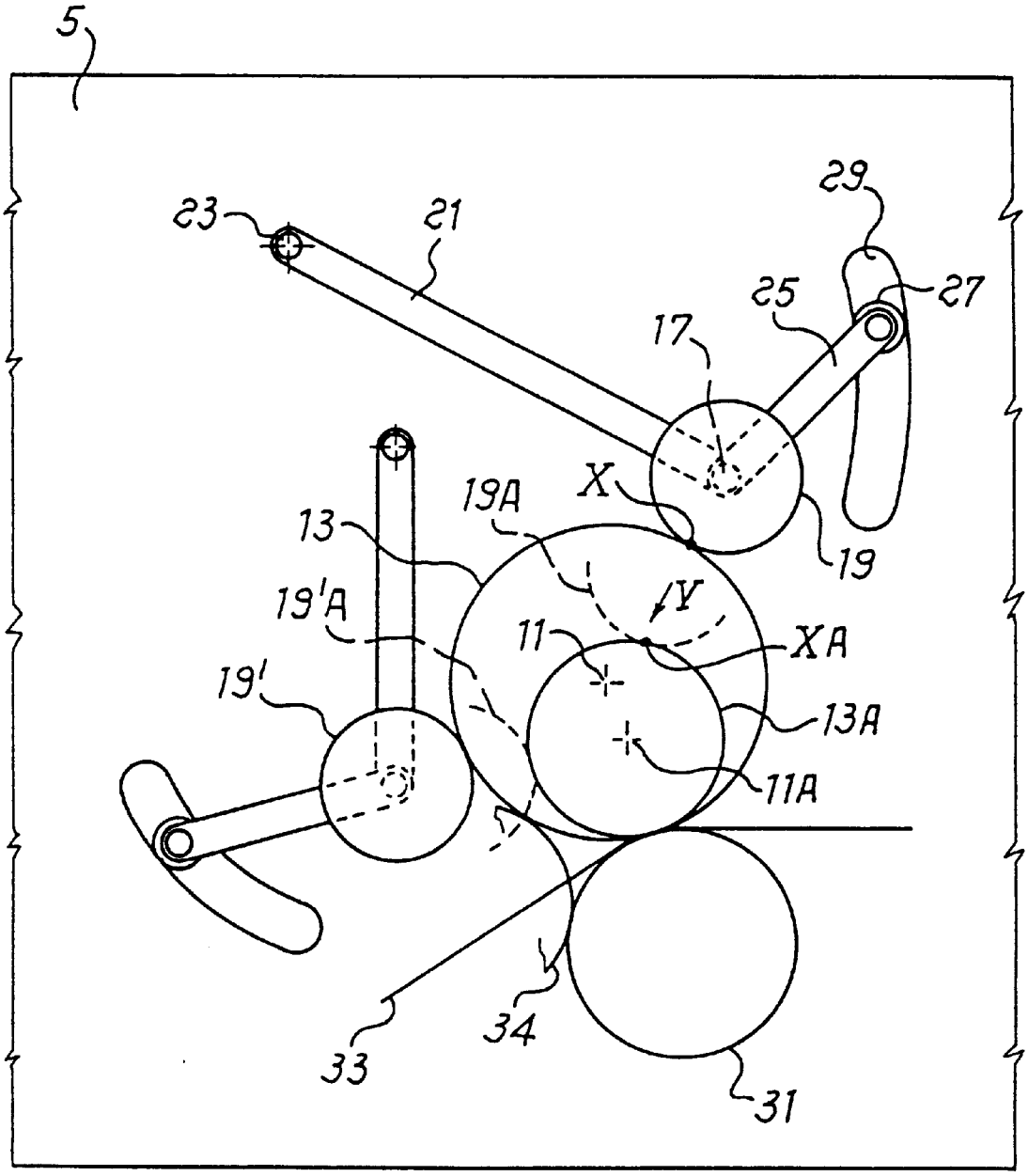
FIG. 2 is a simplified schematic side view of the printing unit of FIG. 1

It is obvious that when the cliché carrying roller 9 is replaced with another one with a different diameter and disks 13A are also of different diameter, the inking roller or rollers 15 will be moved to a position different from the preceding one, e.g. passing from position 19 to position 19A and from position 19' to position 19'A, as shown in FIG. 2 with reference to the cams connected to the inking rollers 15 and 15.' To carry out the above movement of the inking rollers 15 and 15,' the shaft 17 of each of them, for instance that of the roller 15, is supported in a known way by shoulders 5, 7 of the frame 3 of the machine through a pair of levers 21, which are in turn pivoted at their free ends on a support 23 solid with said shoulders 5, 7. Rotating the levers 21 on the pivot supports 23 modifies the position of each inking roller 15 and of the related cams 19, together with the shaft 17, until the inking roller is again in contact with cliché carrying roller 9 of different diameter.

In this situation, it is obvious that the position of the cam 19 with respect to the disk 13 of the cliché roller 9 is changed.

For instance, with reference to FIG. 2, the point X of contact between the cam 19 and disk 13 of a particular cliché carrying roller will move to the point XA when the inking roller 15 and therefore the cam 19 are made to rotate about the pivot 23 to adapt them to a new cliché carrying roller whose disk 13A is of smaller diameter than the previous one.

To avoid a new setting up operation in these conditions each time, means are provided by the invention which guarantee the correct positioning of the point XA in correspondence to the contact with the disk 13*a,* as shown by Y in FIG. 2. These means therefore determine a rotation of the cams 19, as a consequence of the rotation of the inking roller 15 around the pivot 23, whch rotation of the cams 19 is related to the movement of the roller, and therefore of the axis 17 of the same, in such a way as to compensate for said movement of the point of contact between cam and disk that otherwise would occur.

As shown in the drawing, these means for maintaining the registration are essentially in the form of an arm 25 that is solidly linked in rotation to the shaft 17 of the inking roller 15, to which shaft 17 is also fixed the cam 19. The arm 25 carries a cam-follower 27 that moves in a groove 29 cut into the shoulder 5 of the machine frame 3; the groove 29 is precisely shaped to compensate any movement due to the rotation around the pivot 23, and maintain the point of contact X between cam and disk even in the case of variation of the diameter of the cliché carrying roller, guaranteeing that the point of contact X for the disk 13 goes exactly in the point of contact X for the disk 13A of a cliché carrying roller of a different diameter.

In this way the operation of setting-up the machine after each change of format is completely avoided, with great advantages in efficiency.

I claim:

1. A continuous printing machine, specially for typographical printing, with one or more printing units in series, each of which comprises:

a frame (3), at least one cliché carrying roller (9) rotatably fitted on the frame (3) and operating on the ribbon of material to be printed in cooperation with a counterpressure or print roller (31), said cliché carrying roller (9) being interchangeable with other cliché carrying rollers of different diameters, at least one inking roller (15) rotatably fitted on the frame (3), parallel to and in contact with said cliché carrying roller (9), the axis of said inking roller or rollers (15) being mobile along an arc of a circle to keep a working contact between such inking rollers (15) and cliché carrying rollers (9) with different diameters, means (13, 19) for adjusting the contact pressure between the surfaces of the cliché carrying and inking rollers, comprising:

at least one disk (13) coupled to each cliché carrying roller (9), at least one cam (19) coupled to the shaft of each inking roller (15), said cam being in contact with the cliché carrying roller disk (13), characterized in that said cam (19) is operatively connected to said frame (3) by means (29, 27, 25) that determine a rotation of the same corresponding to each movement of the shaft of the cliché carrying roller, giving an automatic adjustment of its position to any variation in the position of said shaft and in the diameter of the cliché carrying roller (9), in such a way as to maintain unchanged the point of contact of the cam (19) with the disk or the disks (13) on each cliché carrying roller.

2. A printing machine according to claim 1, characterized in that said connection means (29, 27, 25) of the cam (19) to the frame comprise an arm (25) having one end rotatably linked with the cam (19) and the other end carrying a cam-follower (27) which moves along a shaped profile.

3. A printing machine according to claim 2, characterized in that said shaped profile is in the form of a groove (29) disposed on the frame (3).

4. A printing machine according to claim 1, characterized in that each inking roller (15) is supported by a pair of levers, pivoted on the ends of the shaft of the inking roller (15), and respectively to aligned points on the frame.

* * * * *